US009155380B2

(12) United States Patent
Raddick

(10) Patent No.: US 9,155,380 B2
(45) Date of Patent: Oct. 13, 2015

(54) FLUID DISPENSER FOR FLOORS

(76) Inventor: Mark Raddick, Dunnville (CA)

( * ) Notice: Subject to any disclaimer, the term of this patent is extended or adjusted under 35 U.S.C. 154(b) by 584 days.

(21) Appl. No.: 13/597,759

(22) Filed: Aug. 29, 2012

(65) Prior Publication Data

US 2012/0328351 A1 Dec. 27, 2012

Related U.S. Application Data

(63) Continuation-in-part of application No. 12/426,328, filed on Apr. 20, 2009, now abandoned.

(60) Provisional application No. 61/048,250, filed on Apr. 28, 2008.

(51) Int. Cl.

| | |
|---|---|
| ***B43K 23/02*** | (2006.01) |
| ***A47L 13/00*** | (2006.01) |
| ***B43M 11/02*** | (2006.01) |
| ***A46B 11/06*** | (2006.01) |
| ***A46B 11/00*** | (2006.01) |
| ***A47L 13/22*** | (2006.01) |
| ***A47L 13/26*** | (2006.01) |
| ***A47L 13/50*** | (2006.01) |
| ***A45F 5/02*** | (2006.01) |
| ***A45F 3/14*** | (2006.01) |

(52) U.S. Cl.

CPC ..... *A46B 11/063* (2013.01); *A45F 3/14* (2013.01); *A45F 5/021* (2013.01); *A46B 11/0062* (2013.01); *A47L 13/22* (2013.01); *A47L 13/26* (2013.01); *A47L 13/50* (2013.01); *A45F 2200/0575* (2013.01); *A46B 2200/302* (2013.01)

(58) Field of Classification Search

CPC ..... A47L 13/22; A47L 13/50; A46L 13/26; A45F 3/14; A45F 5/021

USPC ..... 401/48, 118, 123, 139, 137, 131; 15/115–120.2

See application file for complete search history.

(56) References Cited

U.S. PATENT DOCUMENTS

| | | | | |
|---|---|---|---|---|
| 3,457,015 | A * | 7/1969 | Taber | 401/48 |
| 3,926,448 | A * | 12/1975 | Reichard | 280/1.5 |
| 5,215,355 | A * | 6/1993 | Klumpjan | 298/6 |
| 6,017,163 | A * | 1/2000 | Keppers et al. | 401/48 |
| 6,550,998 | B1 * | 4/2003 | Fernschild et al. | 401/48 |
| 7,600,764 | B1 * | 10/2009 | Parker | 280/47.131 |
| 7,850,383 | B2 * | 12/2010 | Bober et al. | 401/137 |
| 2006/0055128 | A1 * | 3/2006 | Scott et al. | 280/1.5 |

* cited by examiner

*Primary Examiner* — Jennifer C Chiang

(57) ABSTRACT

A fluid dispenser for application of solutions applied to floors is disclosed that includes a frame for supporting a container, wherein the frame includes legs supported by wheels mounted on a bottom end of each leg such that the frame can roll along the surface of a floor. The container is for holding solutions. A mop assembly is for fluidly communicating by gravity feed so that the solution from the container can be manually applied to the mop head. The dispenser further includes a harness attached to the frame for securely attaching the fluid dispenser to the back side lower torso of a person, wherein the harness includes a vertically adjusting mechanism for selectively adjusting the harness vertically according to the height of people.

13 Claims, 11 Drawing Sheets

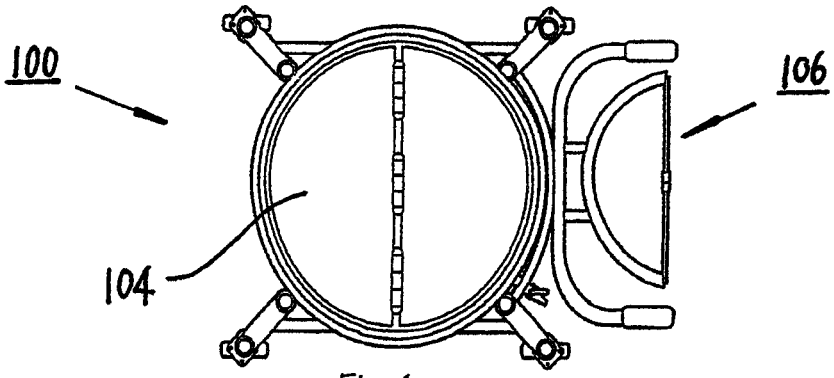
Fig.-1
Fig.-2
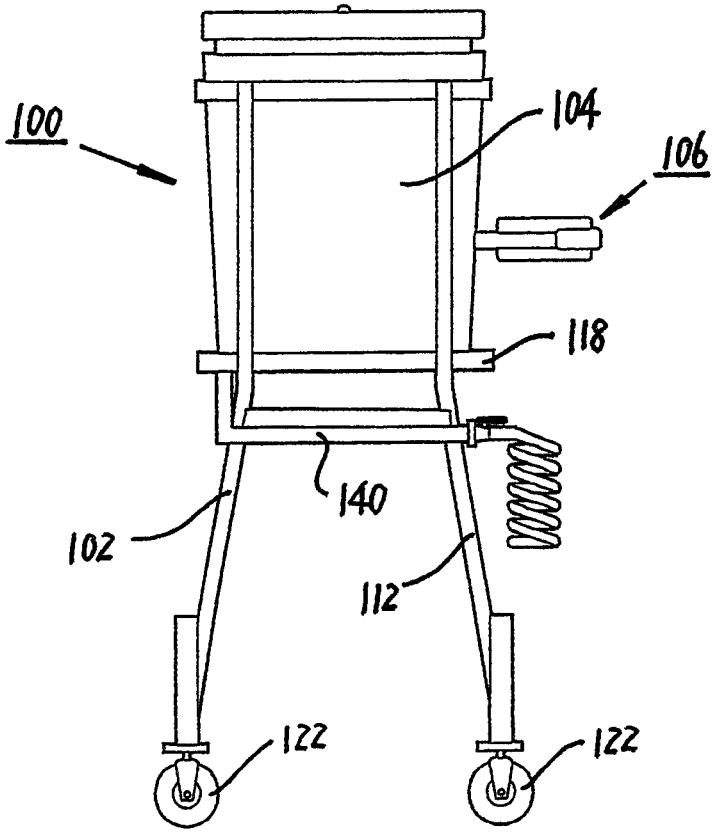

FLUID DISPENSER FOR FLOORS

The present application is a continuation-in-part of prior application Ser. No. 12/426,328, filed Apr. 20, 2009, which is hereby entirely incorporated by reference and claims priority from previously filed U.S. provisional application 61/048,250 filed on Apr. 28, 2008 under the title FLUID DISPENSER FOR FLOORS by Mark Raddick.

FIELD OF THE INVENTION

The present invention relates to devices for dispensing fluids onto floors, in particular relates to a fluid dispenser for floors which is always positioned behind the person using the fluid dispenser. The fluid dispenser for application of solutions applied to floors, includes a frame for supporting a container, the frame includes at least three legs supported by wheels mounted on a bottom end of each leg such that the frame can roll along the surface of a floor. The container is for holding solutions. A mop assembly is for fluidly communicating by gravity feed, the solution from the container to the mop head and bristles and for manually manipulating the mop head. The dispenser further includes a harness attached to the frame for securely attaching the fluid dispenser to the back side of a person such that the frame is always positioned behind the person.

SUMMARY OF THE INVENTION

A fluid dispenser for application of solutions applied to floors and attachment to a person, the fluid dispenser comprising:

a) a frame for supporting a container, the frame includes at least three legs supported by wheels mounted on a bottom end of each leg such that the frame can roll along the surface of a floor;

b) the container for holding liquid solutions;

c) a mop assembly for fluidly communicating the solution from the container to a mop head and bristles and for manually manipulating the mop head;

d) a harness, attached to the frame for securely attaching the fluid dispenser to the back side lower torso of a person such that the frame is always positioned behind the person and in touching relationship to the persons back side lower torso;

e) the harness including a vertically adjusting means for selectively adjusting the harness vertically to position the harness to attach and make contact with the persons back side lower torso thereby adjusting for different persons heights.

Preferrably, the vertically adjusting means including a vertically oriented rack and pinion for adjusting the vertical height of the harness by moving the harness along the rack and releasably locking it at the desired position with the pinion.

Preferrably, the rack including a series of rack teeth wherein the pinion is dimensioned for positioning in between the teeth to selectively lock the harness at a selected height.

Preferrably, the pinion attached to spring biased pinion lever for disengaging the pinion from a normally engaged position in the rack by depressing the pinion lever.

Preferrably, the vertically oriented rack and pinion including at least two racks and two pinions.

Preferrably, the frame and harness adapted for supporting the container and also the person secured in the harness in the event the person loses their footing.

Preferrably, the wheels are positioned such that the center of gravity falls within the wheel support such that the fluid dispenser will support a person that has lost their footing.

Preferrably, the harness includes an adjustable strap and a torso pad, the strap tightly around the lower torso of a person for releasably securing and squeezing the lower torso of a person against the torso pad thereby ensuring the fluid dispenser remains positioned in contact immediately behind the person and in the event the person loses the footing the person will not fall to the ground.

Preferrably, the harness includes at least one handle rigidly connected to the frame and projecting forwardly for grasping in the hand and directing the movement of the fluid dispenser by urging the handle in a selected direction of travel.

Preferrably, there are two handles projecting forwardly on either side of the person for grasping in the hand and directing the movement of the fluid dispenser by urging either handle in a selected direction of travel.

Preferrably, the mop assembly further includes an outlet pipe fluidly connected at one to the container and at the other end to a hose, the outlet pipe including a valve for selecting the amount of flow of solution.

Preferrably, the mop assembly further includes a mop head fluidly connected to the hose for receiving solution and dispersing it evenly onto a bristle.

Preferrably, the mop assembly further including a mop handle for manually manipulating the mop head.

Preferrably, the frame includes a platform connected to the frame for supporting the container at a height above the floor.

BRIEF DESCRIPTION OF THE DRAWINGS

The device will now be described by way of example only with reference to the following drawings:

FIG. 1 is a top plan view of the fluid dispenser.

FIG. 2 is a left side elevational view of the fluid dispenser shown in FIG. 1.

DETAILED DESCRIPTION OF THE PREFERRED EMBODIMENT

Figure 3:
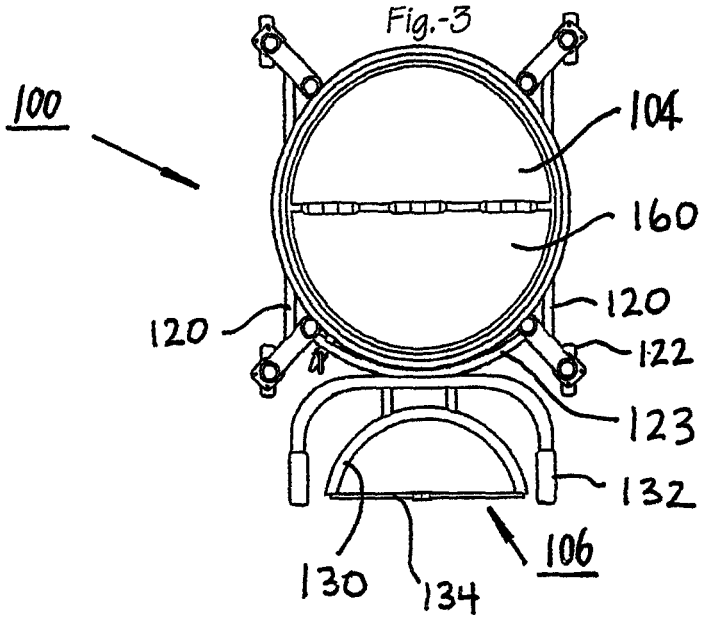
FIG. 3 is a top plan view of the fluid dispenser rotated 90 degrees relative to FIG. 1.

The present device the fluid dispenser shown generally as 100 includes the following major components, namely frame 102, container 104, harness 106 and mop assembly 108.

Frame 102 includes the following components, legs 112 having a top end 125 and bottom end 127, struts 114, upper cage 116, platform 118, cross members 120, and harness bracket 123.

The frame is adapted to move rollably along the surface of a floor by attaching wheels 122 to each bottom end 127 of each leg 112. The wheels can of any type known in the art with one example only depicted in the drawings.

Kindly note in the drawings the frame 102 is shown with four legs 112, however there could be as few as three and there could be any other number larger than three used to support the entire fluid dispenser 100.

The upper portion of each leg 112 becomes a strut 114 which terminates at upper cage 116. Platform 118 is dimensioned to hold container 104 thereon and upper cage 116 is designed to maintain container 104 within the frame 102. The upper cage 116 preferably being a circular ring dimensioned to fit around the outer diameter of a preferably circular container 104. The container and upper cage 116 and container 104 may also be another shape such as square for example.

Harness 106 includes a U-bracket 130, handles 132, a adjustable strap 134 and a clip 136. Clip 136 can be any adjusting variety known in the art such as for example but not limited to a cam buckle, or strap buckle, or slip buckle, or snap buckle adapted to adjust to a variety of different sized persons.

Mop assembly 108 includes an outlet pipe 140 which is fluidly connected to container 104. Outlet pipe 140 terminates at a valve 142 which is fluidly connected to a hose 144 which in turn is fluidly connected to a mop handle 146 and ultimately fluid is dispensed and distributed into mop head 146 and further into bristles 170. Mop assembly 108 further includes a mop handle 150 for attachment to the mop head 146. Fluid is dispensed from container 104 and communicated to mop head 146 and bristles 170.

The mop assembly 108 fluidly communicates the solution from container 104 by gravity feed to the mop head 146 and bristles 170 and is also used for manually manipulating the mop head 146 via mop handle 150. Container 104 optionally includes a lid 160 which includes hinges 162 for pivotally opening and closing a portion of the lid 160.

Mop head 146 and mop 148 may be of various designs including, long bristled type mop, or a short bristled type mop and/or more of scrub pad type mop. The harness includes at least one handle 132 rigidly connected to the frame. Preferably there are two handles 132 projecting forwardly on either side of the person for grasping in the hand and directing the movement of the fluid dispenser by urging either handle 132 in a selected direction of travel.

Figure 5:
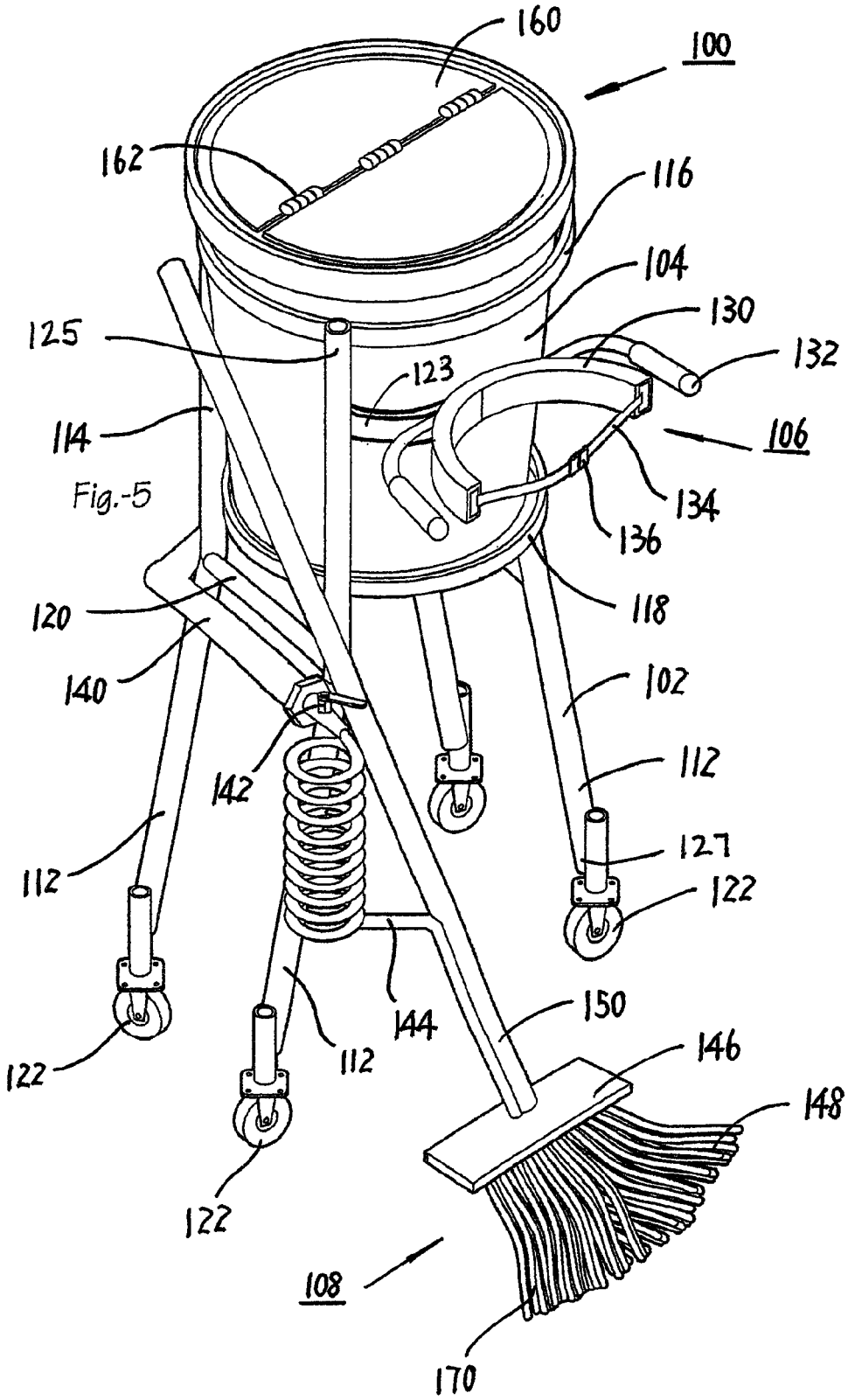
FIG. 5 is a top schematic perspective view of the fluid dispenser shown in FIG. 1.
Figure 6:
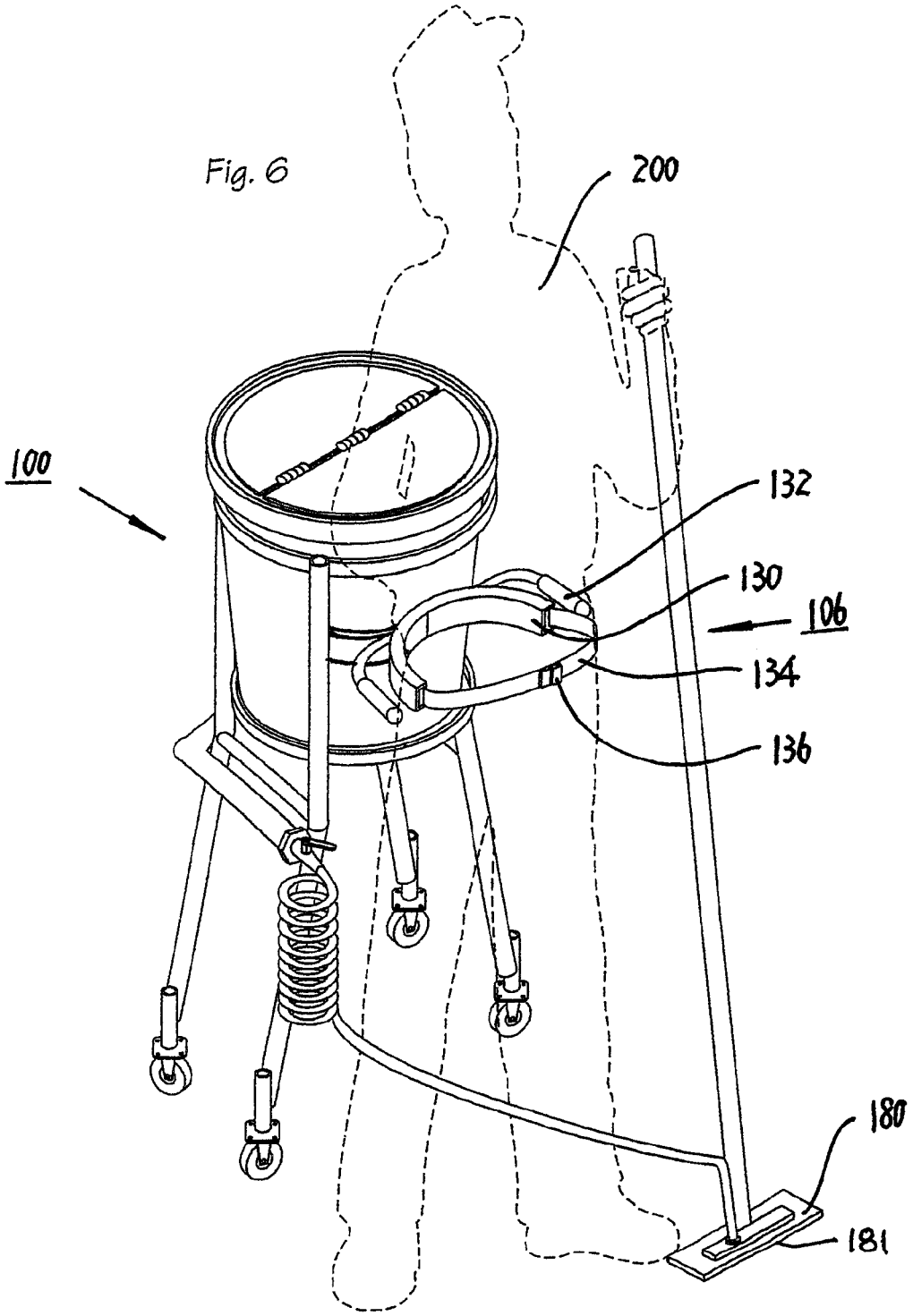
FIG. 6 is a top schematic perspective view of the fluid dispenser shown in FIG. 1, which is deployed onto a person shown in dashed lines.
Figure 7:
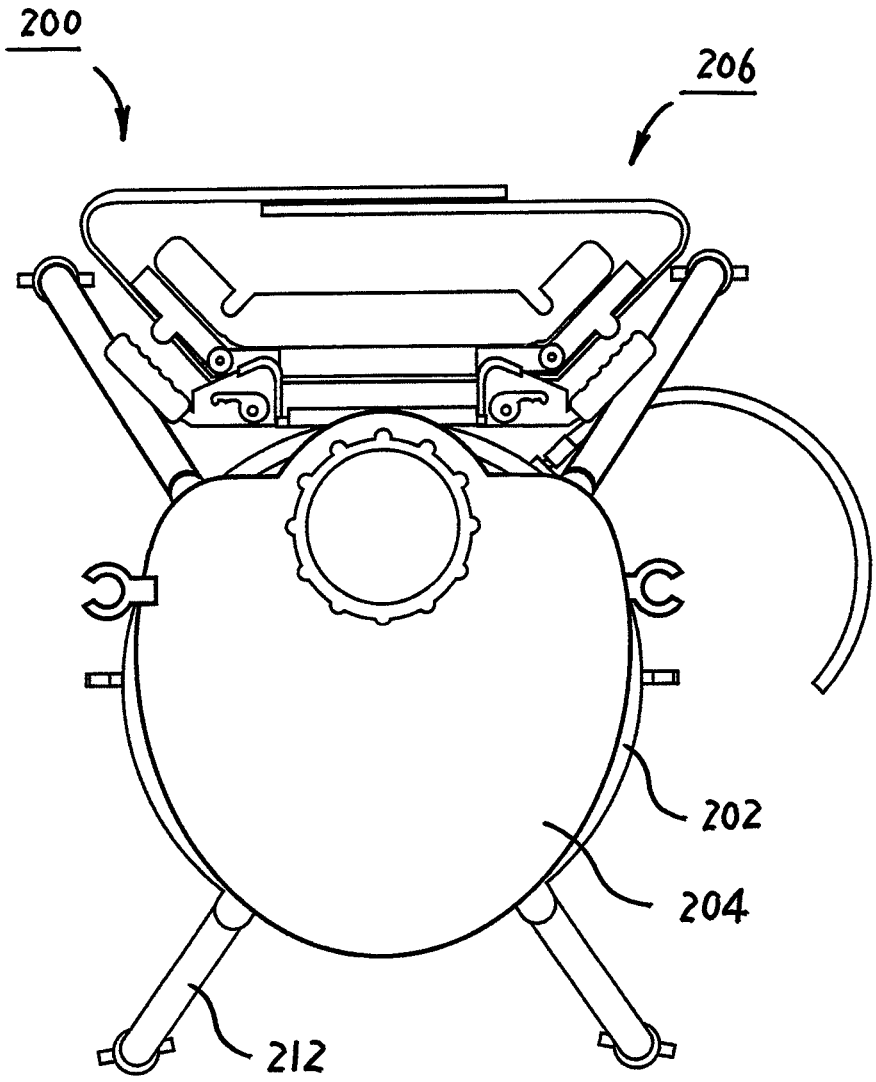
FIG. 7 is a top plan view of the fluid dispenser of the alternative embodiment.
Figure 8:
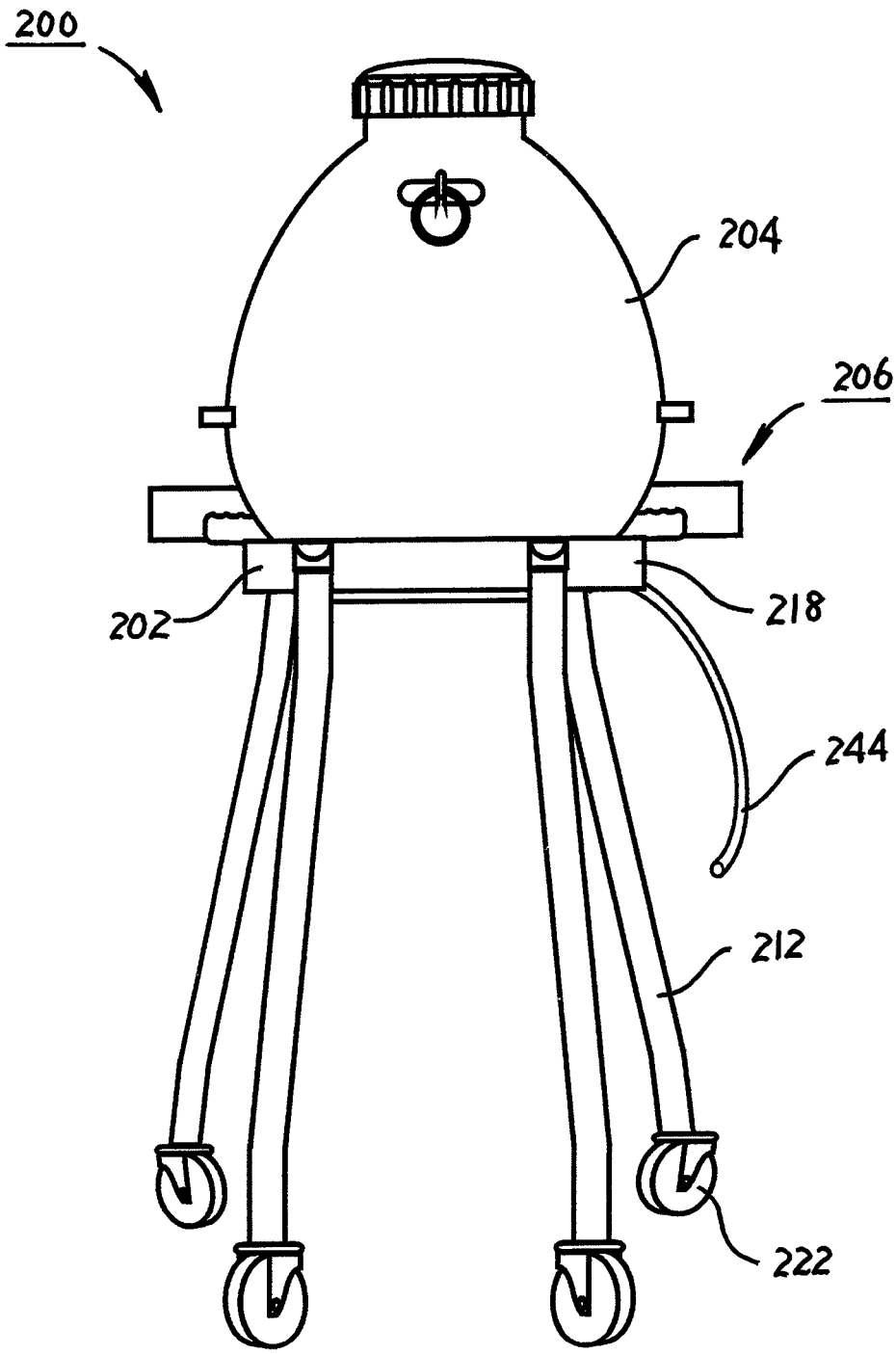
FIG. 8 is a rear elevational view of the fluid dispenser of the alternative embodiment shown in FIG. 7.
Figure 9:
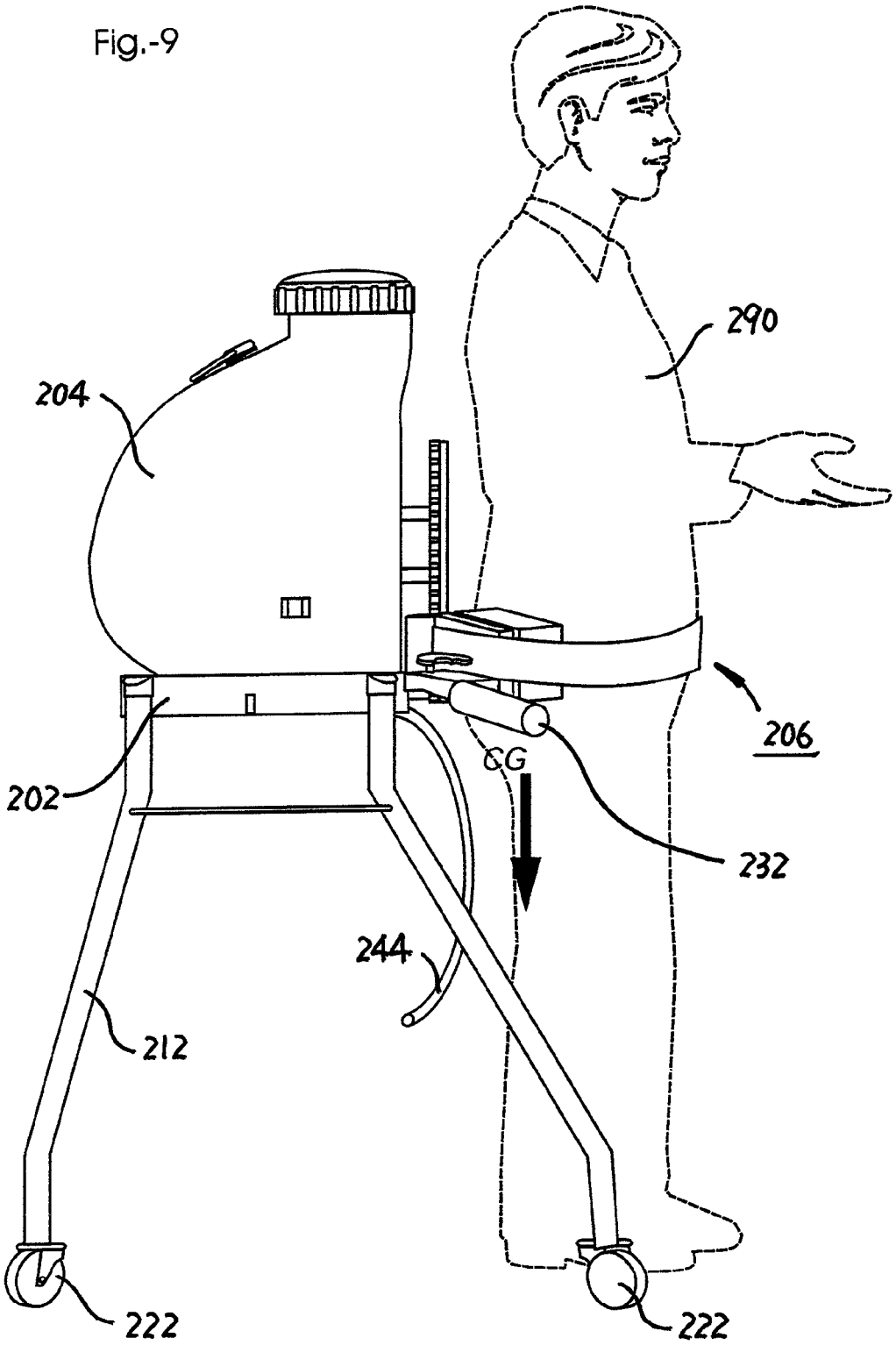
FIG. 9 is a left side elevational view of the fluid dispenser of the alternative embodiment shown in FIG. 7, which is deployed onto a person shown in dashed lines.
Figure 10:
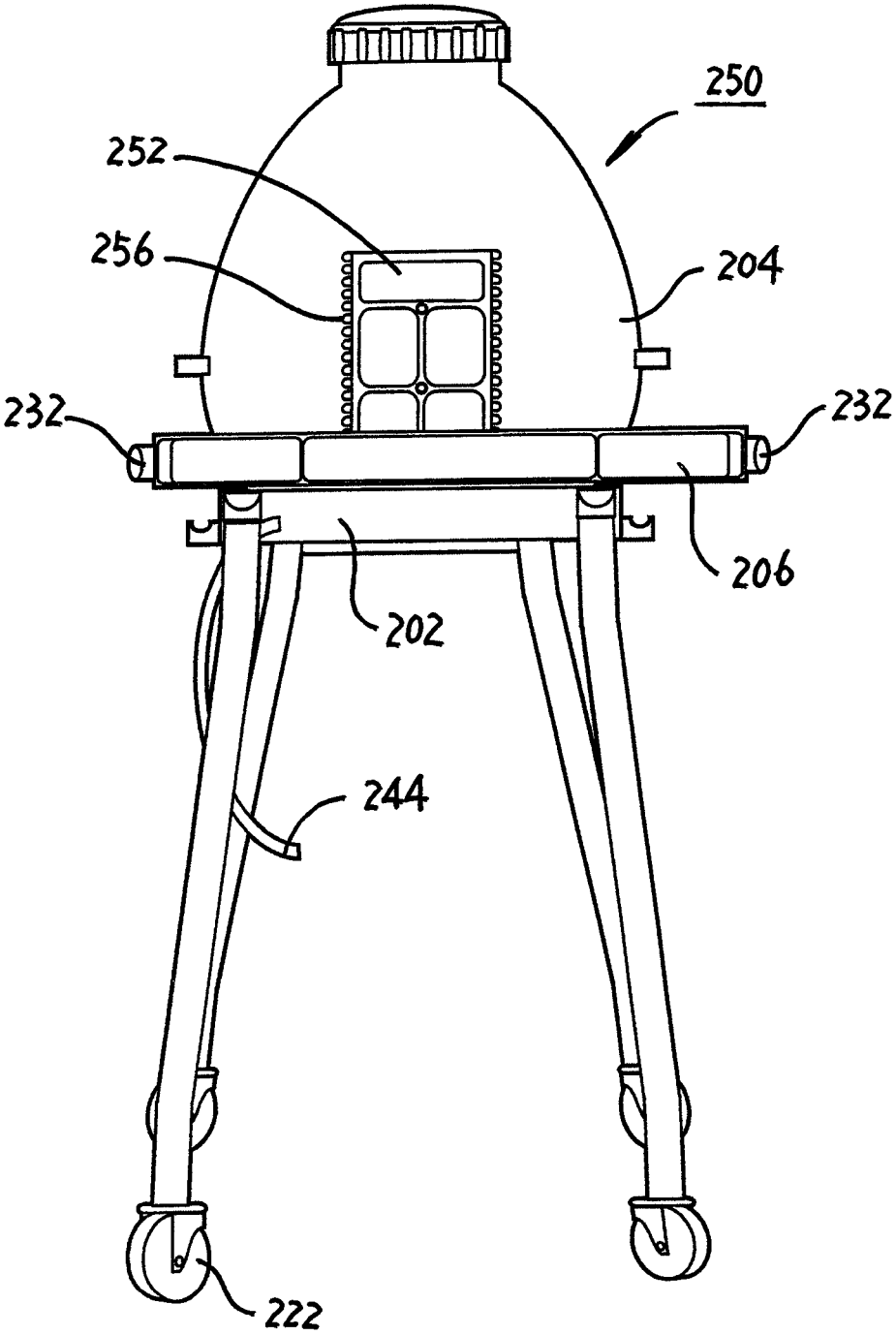
FIG. 10 is a front elevational view of the fluid dispenser shown in FIG. 7.
Figure 11:
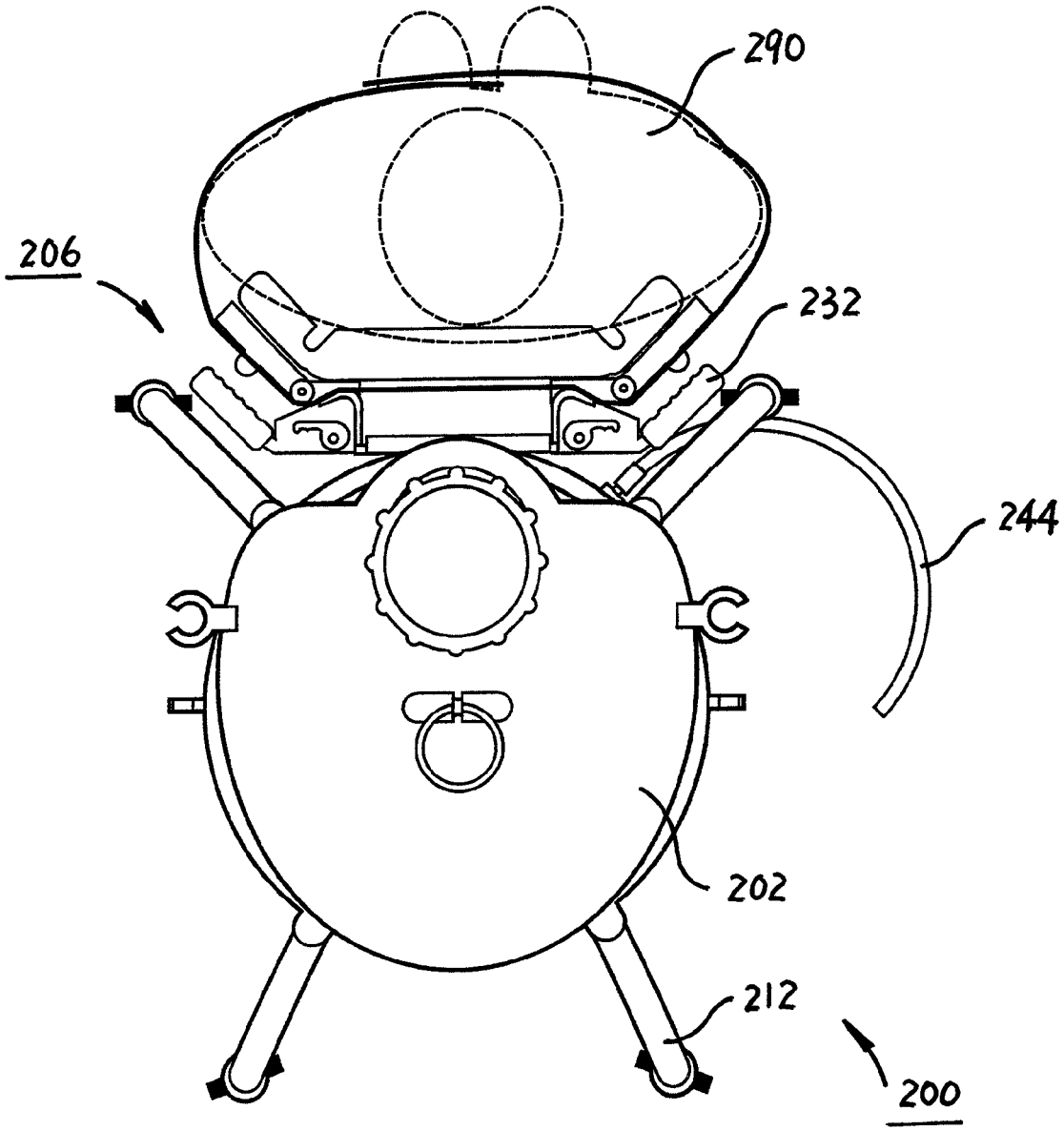
FIG. 11 is a top plan view of the fluid dispenser rotated 90 degrees relative to FIG. 9, wherein the person is shown in dashed lines.

In FIG. 5 for example, mop 148 is shown having long traditional bristles 170 along with mope head 146. In FIG. 6 for example, mop head 180 is shown having no bristles but rather is simply a scrub pad 181 on the bottom of mop head 180 thereon not shown in the view.

Referring now to FIG. 6 a person 190 is shown in dashed lines being fastened into a harness 106, wherein the buttocks or back side of a person is fastened to U-bracket 130 with a adjustable strap 134 which is brought around the hips or front side of person 190 and the ends fastened together using clip 136 together thereby holding person 190 securely to fluid dispenser 100. In this manner the frame 102 of fluid dispenser 100 is always positioned behind the person. Person 190 can use one of the handles 132 for directing the movement of fluid dispenser 100. The back side of a person may include for example the buttocks or lower back or lower back torso depending upon comfort and personal preference.

Figure 4:
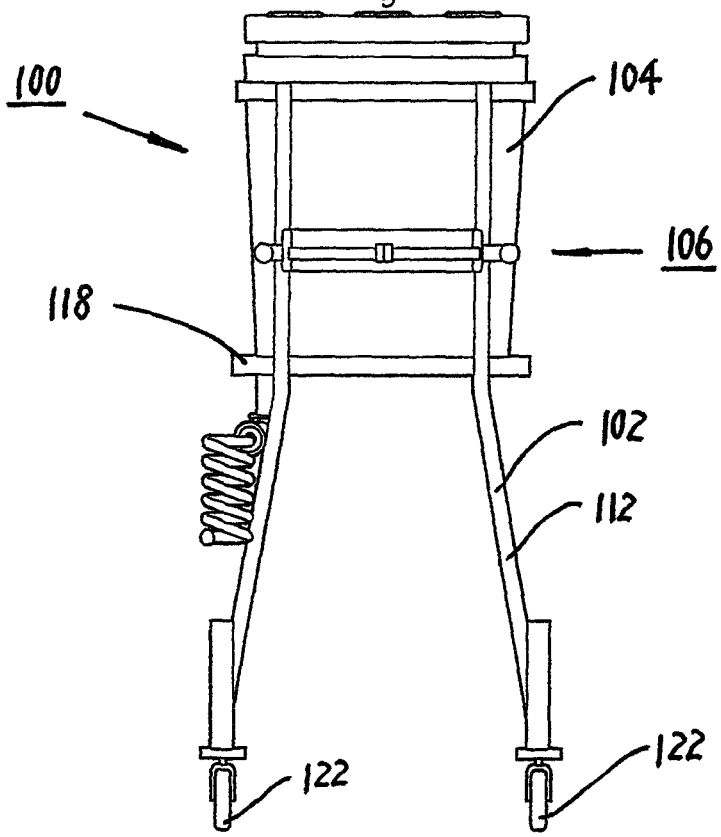
FIG. 4 is a front side elevational view of the fluid dispenser shown in FIG. 1, which further showing the harness features.

In use, the fluid dispenser 100 is used as shown in the FIGS. 4 and 5. The product and/or fluid that one wishes to apply to a floor for example is poured into container 104 through open lid 160. Lid 160 is then optionally closed to prevent splashing of the contents.

The operator of fluid dispenser 100 would strap himself onto fluid dispenser 100 by placing ones buttocks onto U-bracket 130 and fastening adjustable strap 134 with clip 136 around the persons hips. U-bracket 130 is U shaped to fit the contour of the backside of a person.

Product and/or fluid which is applied to the floor is fluidly communicated through outlet pipe 140 which is controlled by adjusting valve 142 to the desired flow rate. Fluid flows down through hose 144 and ultimately down to mop handle 150 and mop head 146 or 180 and onto bristles 170 or scrub pad 181. Valve 142 may be any type known in the art for controlling fluid flow including for example but not limited to a butterfly valve, or ball and cock valve, or plunger and seat valve, or slide gate valve. It may be a manual valve or remotely operated valve.

Person 190 is able to control the flow of fluid from container 104 down to mop head 146 by adjusting manually valve 142 until the desired flow is obtained. The fluid is gravity fed down to the mop head 146.

The reader will note that there is no necessity for pumps or any other type of devices to get fluid down to mop head 146 since the container 104 is elevated above the floor level.

The reader will also note that the fluid dispenser 100 is always positioned behind person 190, therefore it would not get in the way of the person handling the mop assembly 108.

The container 104 of fluid dispenser 100 could be filled with any suitable solutions and could for example be used for applying floor stripper, could be used for applying floor waxes, could be used for applying floor polishes, floor cleaners and/or any other products that are applied to a floors.

One benefit of using fluid dispenser 100 other than the obvious benefits that one can see from the design is that the fluid dispensing unit is always out of the way and always in the correct position relative to the person 190 since it is securely fastened to the back side of a person 190.

This is an important feature when floors become very slippery with the application fluids and/or products to the floor. Should the person 190 lose his footing, he would be supported by fluid dispenser 100 through the harness 106, thereby preventing serious fall.

Fluid dispenser 100 is designed in such a manner that it would support the weight of a person through harness 106 and would not be easily tipped over when the weight of a person is applied to harness 106.

As indicated above many mop designs or bristles can be used in association with the fluid dispenser 100, namely, the traditional long bristle and/or short bristle and/or thin scrub pad 181. The term bristle is used for any of these types. The mop head 146 is fluidly connected to the hose 144 and is designed to receive the solution and disperse it evenly onto the bristles depicted as 170 or 181.

Alternative Embodiment

FIGS. 7 through 16 shows an alternative embodiment of the fluid dispenser, wherein the harness further includes a vertically adjusting means for selectively adjusting the harness vertically to position the harness to attach and make contact with the person back side lower torso according to the height of the person.

The fluid dispenser of the alternative embodiment shown generally as 200 also includes the following major components, namely frame 202, container 204, harness 206.

The frame 202 has the similar components as the frame 102 of fluid dispenser 100. The frame 202 supports the container 204 holding liquid solutions in use. At least three legs 212 are supported by wheels 222 mounted on the bottom end of each leg, thus allowing the frame rolling along the floor surface. The frame 202 also includes a platform 218 which supports the container 204 at a height above the floor.

The harness 206 is secured to the frame 202 by the same mechanism disclosed above. The harness 206 further includes a vertically adjusting means 250 for selectively adjusting the harness 206 vertically to position the harness 206 to attach and make contact with the back side lower torso of the person 290, which can be seen in FIGS. 9 and 11. Since the vertical position of the harness 206 can be adjusted according to the heights of different people, the frame 202 is always positioned behind the person and in touching relationship to the person's back side lower torso.

Figure 12:
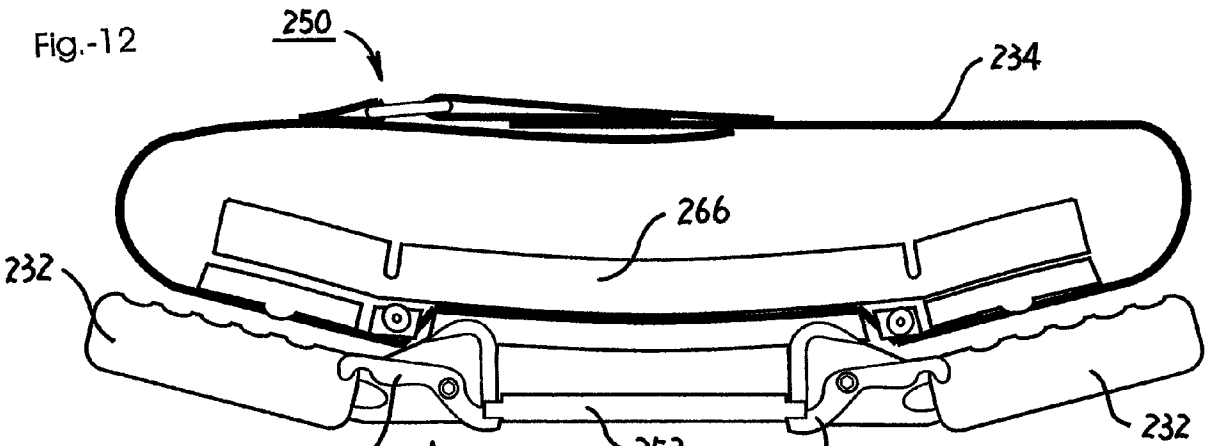
FIG. 12 is a top plan view of the vertically adjusting means of the fluid dispenser shown in FIG. 7.
Figure 13:
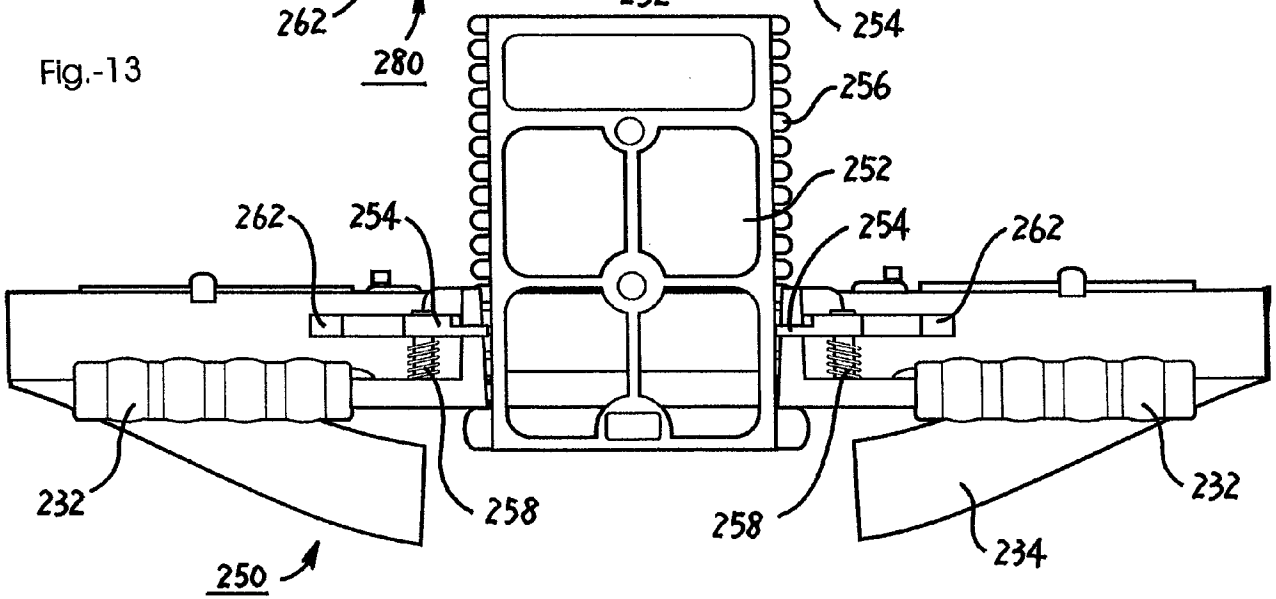
FIG. 13 is a front elevational view of the vertically adjusting means of the fluid dispenser shown in FIG. 7.

The components of the vertically adjusting means 250 are depicted in FIGS. 12 and 13. The adjusting means 250 includes a vertically oriented rack 252 and pinion 254 for adjusting the vertical height of the harness 206 by moving the harness 206 along the rack 252 and releasably locking it at the desired position with the pinion 254.

Figure 14:
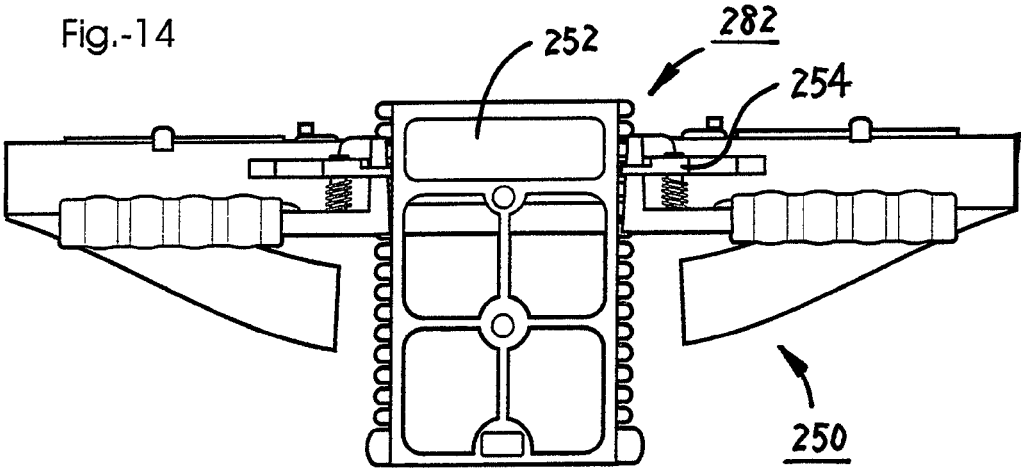
FIG. 14 is a schematic front elevational views of the vertically adjusting means shown in FIG. 13, wherein the rack teeth are releasably locked with the pinion at the top of the rack.
Figure 15:
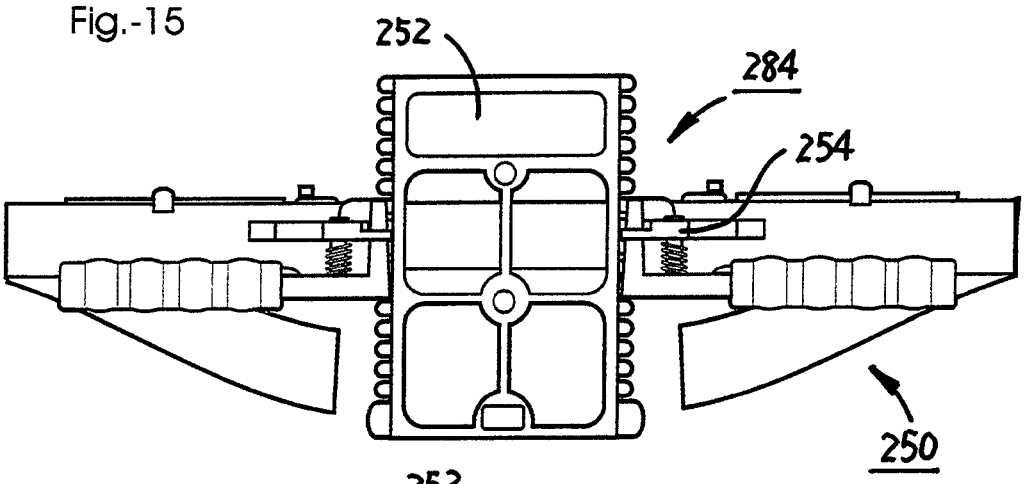
FIG. 15 is a schematic front elevational views of the vertically adjusting means shown in FIG. 13, wherein the rack teeth are releasably locked with the pinion in the middle of the rack.
Figure 16:
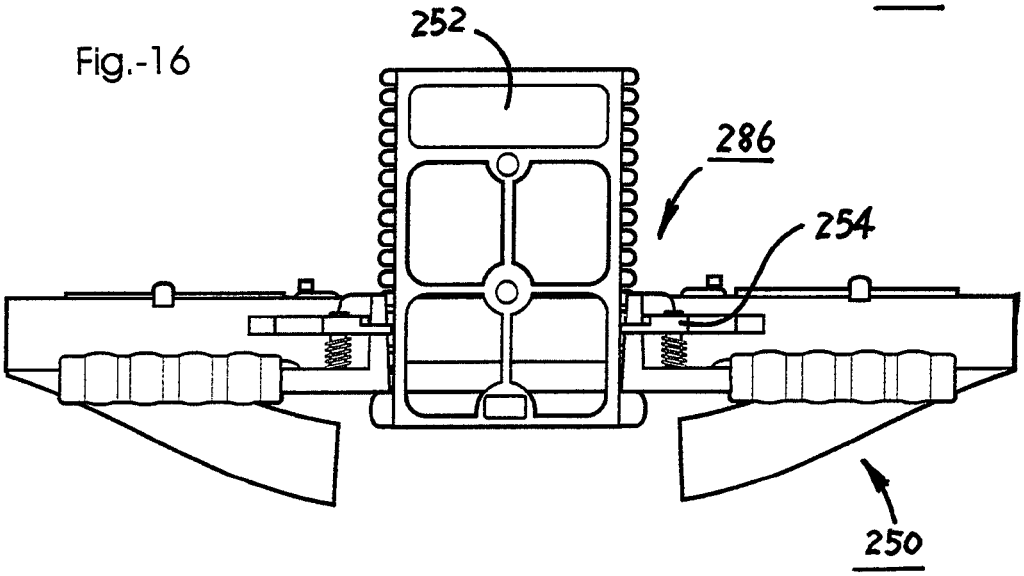
FIG. 16 is a schematic front elevational views of the vertically adjusting means shown in FIG. 13, wherein the rack teeth are releasably locked with the pinion at the bottom of the rack.

The rack 252 further includes a series of rack teeth 256 set vertically, wherein the pinion 254 is dimensioned for positioning in between the teeth 256 to selectively lock the harness 206 at a selected height. The pinion 254 is attached to spring 258 biased pinion lever 262 for disengaging the pinion 254 from a normally engaged position 280 in the rack 252 by depressing the pinion lever 262. Preferably, the vertically oriented rack 252 and the pinion 254 includes at least two racks and two pinions. FIGS. 14 through 16 schematically show the harness 206 at different vertical positions 282, 284 and 286 when the person 290 presses the pinion lever 262.

Preferrably, the harness 206 includes an adjustable strap 234 and a torso pad 266, wherein the strap 234 is tightly fastened around the lower torso of the person 290 for releasably securing and squeezing the lower torso of the person 290 against the torso pad 266, thereby ensuring the fluid dispenser 200 remains positioned in contact immediately behind the person 290 and in the event the person 290 loses the footing. Therefore, serious injury of falling can be avoided.

Preferably, the harness 206 further includes at least one handle 232 which is rigidly connected to the frame 202 and projects forwardly for grasping in the hand. Person 290 can direct the movement of the fluid dispenser 200 by urging the handle 232 in a selected direction of travel. More preferably, two handles 232 are provided on both torso sides of person 290 for better control of the fluid dispenser 200.

The same mop assembly as used in the fluid dispenser 100, which are not shown herewith in FIGS. 7 through 11, are connected with the hose 244 which is in fluid communication with the container 204. Thus, the solution within the container 204 can be dispersed through the hose 244 to the mop assembly. Preferrably, the mop assembly further includes an outlet pipe fluidly connected at one end to the container 204 and at the other end to the hose 244. The outlet pipe can further include a valve to control the amount of flow of solution. More preferably, the mop assembly further includes a mop head fluidly connected to the hose 244 for receiving solution within the container 204 and dispersing it evenly onto a bristle. Furthermore, the mop assembly includes a mop handle for manually manipulating the mop head.

The frame and the harness of the fluid dispenser are configured to support the container and also the person secured in the harness in the event the person loses his footing.

It is also known to the person skilled in the art that the wheels 222 are positioned such that the center of gravity falls within the wheel support such that the fluid dispenser 200 will support the person 290 who has lost his footing.

It should be apparent to persons skilled in the arts that various modifications and adaptation of this structure described above are possible without departure from the spirit of the invention the scope of which defined in the appended claim.

I claim:

1. A fluid dispenser for application of solutions applied to floors and attachment to a person, the fluid dispenser comprising:

a) a frame for supporting a container, the frame includes at least three legs supported by wheels mounted on a bottom end of each leg such that the frame can roll along the surface of a floor;

b) the container for holding liquid solutions;

c) a mop assembly for fluidly communicating the solution from the container to a mop head and bristles and for manually manipulating the mop head;

d) a harness, attached to the frame for securely attaching the fluid dispenser to the back side lower torso of a person such that the frame is always positioned behind the person and in touching relationship to the person's back side lower torso;

e) the harness including a vertically adjusting means for selectively adjusting the harness vertically to position the harness to attach and make contact with the person's back side lower torso thereby adjusting for different person's heights;

f) wherein the vertically adjusting means including a vertically oriented rack and pinion for adjusting the vertical height of the harness by moving the harness along the rack and releasably locking it at the desired position with the pinion.

2. The fluid dispenser claimed in claim 1 wherein rack including a series of rack teeth wherein the pinion is dimensioned for positioning in between the teeth to selectively lock the harness at a selected height.

3. The fluid dispenser claimed in claim 1 wherein the pinion attached to spring biased pinion lever for disengaging the pinion from a normally engaged position in the rack by depressing the pinion lever.

4. The fluid dispenser claimed in claim 1 wherein vertically oriented rack and pinion including at least two racks and two pinions.

5. The fluid dispenser claimed in claim 1 wherein the frame and harness support the container and also secures the person in the harness in the event the person loses their footing.

6. The fluid dispenser claimed in claim 5 wherein the wheels are positioned such that the center of gravity falls within the wheel support such that the fluid dispenser will support a person that has lost their footing.

7. The fluid dispenser claimed in claim 1 wherein the harness includes an adjustable strap and a torso pad, the strap tightly around the lower torso of a person for releasably securing and squeezing the lower torso of a person against the torso pad thereby ensuring the fluid dispenser remains positioned in contact immediately behind the person and in the event the person loses the footing the person will not fall to the ground.

8. A fluid dispenser for application of solutions applied to floors and attachment to a person, the fluid dispenser comprising:

a) a frame for supporting a container, the frame includes at least three legs supported by wheels mounted on a bottom end of each leg such that the frame can roll along the surface of a floor;

b) the container for holding liquid solutions;

c) a mop assembly for fluidly communicating the solution from the container to a mop head and bristles and for manually manipulating the mop head;

d) a harness, attached to the frame for securely attaching the fluid dispenser to the back side lower torso of a person such that the frame is always positioned behind the person and in touching relationship to the person's back side lower torso;

e) the harness including a vertically adjusting means for selectively adjusting the harness vertically to position the harness to attach and make contact with the person's back side lower torso thereby adjusting for different person's heights;

f) wherein the harness includes at least one handle rigidly connected to the frame and projecting forwardly for grasping in the hand and directing the movement of the fluid dispenser by urging the handle in a selected direction of travel.

9. The fluid dispenser claimed in claim 8 wherein there are two handles projecting forwardly on either side of the person for grasping in the hand and directing the movement of the fluid dispenser by urging either handle in a selected direction of travel.

10. The fluid dispenser claimed in claim 1 wherein the mop assembly further includes an outlet pipe fluidly connected at one end to the container and at the other end to a hose, the outlet pipe including a valve for selecting the amount of flow of solution.

11. The fluid dispenser claimed in claim 10 wherein the mop assembly further includes a mop head fluidly connected to the hose for receiving solution and dispersing it evenly onto a bristle.

12. The fluid dispenser claimed in claim 11 wherein the mop assembly further including a mop handle for manually manipulating the mop head.

13. The fluid dispenser claimed in claim 12 wherein the frame includes a platform connected to the frame for supporting the container at a height above the floor.

* * * * *